United States Patent [19]

Crosslen

[11] 4,254,595

[45] Mar. 10, 1981

[54] REMOVABLE COVER FOR ROOF GUTTER

[76] Inventor: Louis J. Crosslen, 1108 Second Ave., Grafton, Wis. 53024

[21] Appl. No.: 26,919

[22] Filed: Apr. 4, 1979

[51] Int. Cl.[3] ..... E04D 13/06

[52] U.S. Cl. ..... 52/11; 52/95; 248/48.1

[58] Field of Search ..... 52/11-15, 52/20, 95; 248/48.1

[56] References Cited

U.S. PATENT DOCUMENTS

| | | | |
|---|---|---|---|
| 453,948 | 6/1891 | Smith et al. | 52/12 |
| 836,012 | 11/1906 | Cassen | 52/12 |
| 846,238 | 3/1907 | O'Dowd | 52/11 |
| 1,005,885 | 10/1911 | Ross et al. | 52/11 |
| 2,209,741 | 7/1940 | Sullivan et al. | 52/11 |
| 2,583,422 | 1/1952 | Haddon | 52/12 |
| 3,344,562 | 10/1967 | Miles et al. | 52/11 |

*Primary Examiner*—James L. Ridgill, Jr.
*Attorney, Agent, or Firm*—James E. Nilles

[57] ABSTRACT

A cover formed of sheet material which is removably placed over a roof gutter to prevent the accumulation and build-up of ice in the gutter and under the roof shingles. The cover extends under the lower row of shingles on the roof and then over the gutter where its leading edge is removably attached to the outer edge of the gutter. The outer edge of the cover has a generally U-shaped groove formed of spaced apart downwardly extending flanges which embrace the bead of the groove to hold the cover securely but removably in place. Other forms of covers having different gutter attaching means are also provided.

4 Claims, 9 Drawing Figures

REMOVABLE COVER FOR ROOF GUTTER

BACKGROUND OF THE INVENTION

Various forms of covers for gutters have been proposed to keep out foreign material, but have had various shortcomings such as being difficult to insert or remove and also being subject to inadvertent removal due, for example to high winds. Some other of these prior art devices were complicated in that they required certain attaching devices to hold them securely in place and were difficult to install and remove.

SUMMARY OF THE INVENTION

The present invention provides an elongated cover for extending over and covering a roof gutter and which cover has a rear edge along its length that is insertable under a row of shingles on the roof. One form of the cover has a U-shaped groove along its front edge which faces downwardly and is comprised of a pair of spaced apart flanges which act to embrace or grip the bead of the groove. The inner flange of the U-shaped groove is slotted along its length to provide a series of individual tabs, each of which may be selectively folded upwardly to thereby accommodate a gutter hanger extending from the roof to the bead of the groove. A more specific aspect of the invention relates to the formation of the generally U-shaped groove and which is formed by the sheet material being folded back upon itself to define an outer downwardly extending flange spaced from the inner flange. These flanges may be formed relative to one another to provide a gripping action on the bead to which they are removably secured.

Other forms of cover attaching means are also provided, including removable sections that snap onto the gutter bead, or clips that are secured to the edge of the cover and which snap into the gutter bead.

These and other objects and advantages of the present invention will appear hereinafter as this disclosure progresses, reference being had to the accompanying drawings.

DESCRIPTION OF A PREFERRED EMBODIMENT

Figure 1:
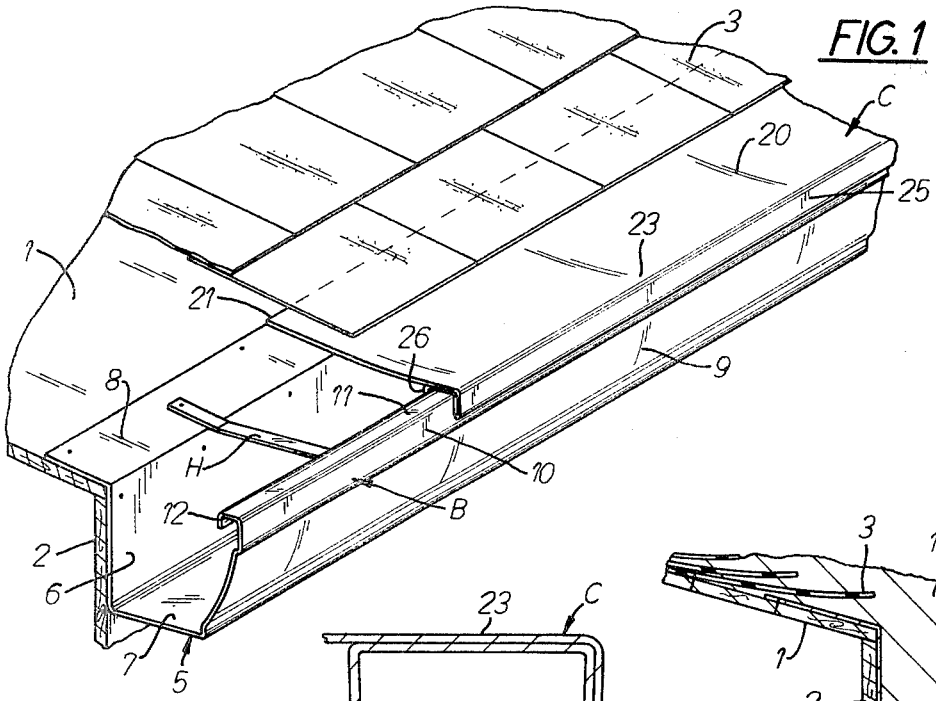
FIG. 1 is a fragmentary, perspective view of a roof having a gutter attached thereto and showing the gutter cover provided by the present invention, certain parts being removed or broken away for the sake of clarity in the drawing.

The invention has been shown in FIG. 1 as applied to a roof 1 having a downwardly extending facia board 2 and also having a lower row of shingles 3 along the lower edge of the roof. The gutter 5 is conventional and includes a rear wall 6, a bottom wall 7, an upper flange 8 secured to the roof 1, and an outer wall 9 of the gutter. The outer upper edge of the gutter wall 9 is fabricated as a bead B and the bead includes an outer portion 10, an upper portion 11, and a rear portion 12.

Figure 6:
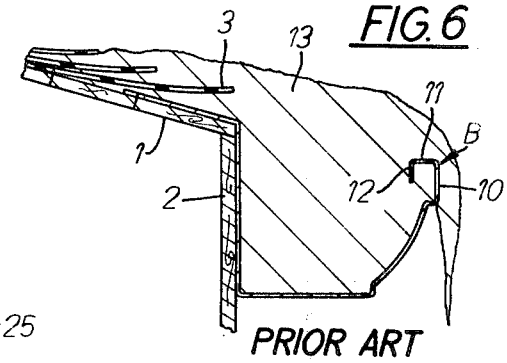
FIG. 6 is a sectional view through a conventional gutter, without a cover, and showing the ice build up under the shingles.

FIG. 6 shows the conventional gutter as attached to the roof and having ice 13 accumulated therein and which has built up under the shingles 3 to a point where leakage occurs through the roof.

Figure 3:
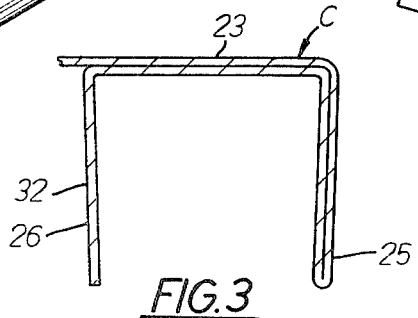
FIG. 3 is an enlarged, transverse, cross-sectional view of a portion of the cover shown in FIG. 2, further illustrating the fabrication of the generally U-shaped groove along the outer edge of the cover.

In accordance with the present invention, a gutter cover C is fabricated from sheet metal, plastic or the like and is formed in elongated sections, say for example four or eight feet in length. The cover includes an upper portion 20 having a rear edge 21 that is adapted to be inserted under the lower row of shingles 3. The front edge 23 of the cover has a pair of downwardly extending flanges therealong which define a downwardly facing and generally U-shaped groove G along the front edge of the cover. More specifically, the flanges include an outer flange 25 and an inner or rearward flange 26. As shown in FIG. 3, the outer flange 25 is fabricated by the sheet material being bent over upon itself so that the flange 25 is of double thickness whereas the rearward flange 26 is of a single thickness. As also shown in FIG. 3, the flanges 25 and 26 are formed relative to one another so as to provide resilient gripping action on the bead B. More specifically, either one or both of the flanges 25, 26 are turned inwardly toward one another so that when they are pressed over the bead B, they are forced to resiliently separate or move apart from one another to provide a gripping action on the bead.

Figure 2:
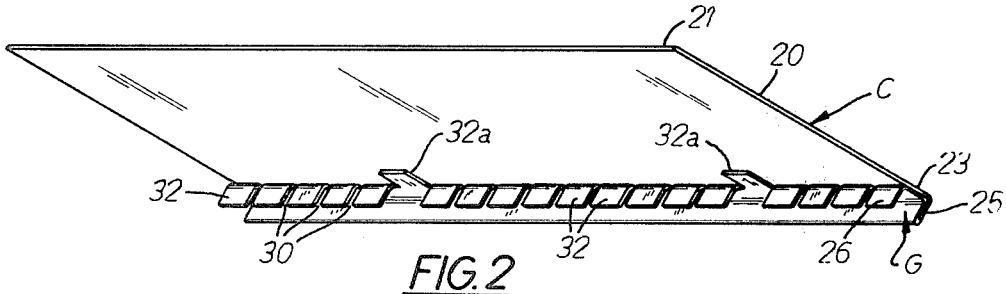
FIG. 2 is a perspective view of the roof gutter taken generally from the underside thereof and showing two of the individual tabs of the inner flange folded upwardly so as to accommodate the gutter hangers.
Figure 4:
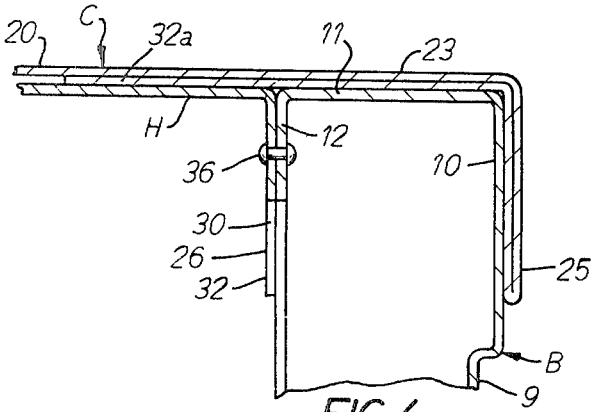
FIG. 4 is a view similar to FIG. 3, but showing the cover attached to the bead of the gutter and furthermore showing the tab of the inner flange of the cover in the upwardly folded direction to accommodate a gutter hanger.
Figure 5:
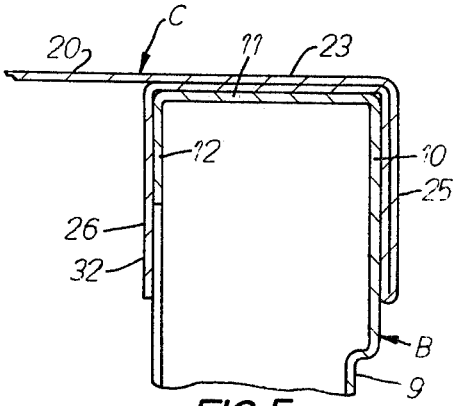
FIG. 5 is a view similar to FIG. 4, the view being taken through the gutter where no hanger is located.

As shown in FIG. 2, the inner flange of the U-shaped groove has a series of spaced apart generally vertical slits 30 formed therein so as to provide a series of individual tabs 32 along the length of the inner flange. These tabs 32 may be individually turned upwardly as shown in FIG. 2 by the tabs 32*a* so as to accommodate the generally horizontally extending gutter hanger H as shown in FIG. 4. Thus the tabs 32 may be turned up as required by the spacing of the hangers H. As also shown in FIG. 4, the hanger has previously been secured to the bead B by rivets 36.

Figure 7:
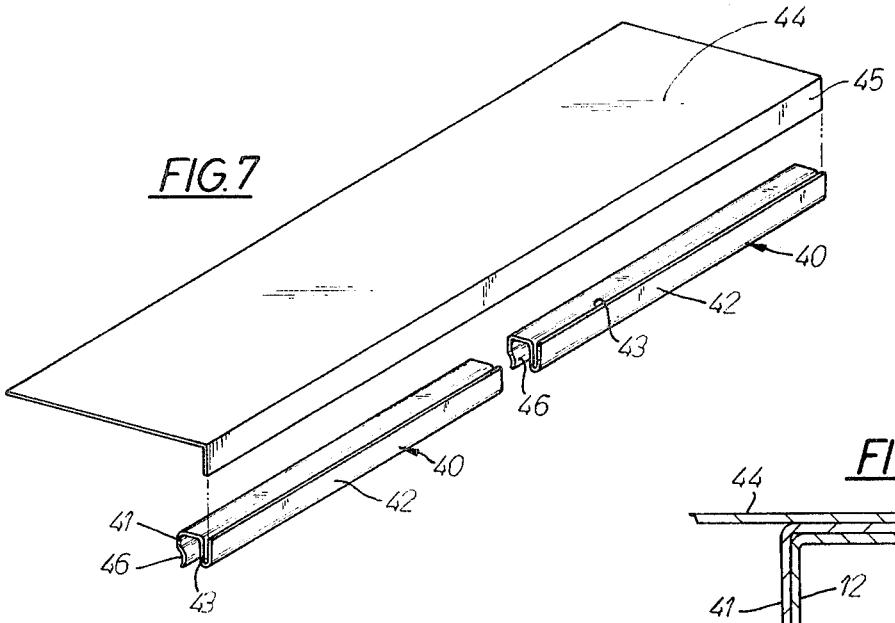
FIG. 7 is a perspective view of a modified form of gutter cover and attaching means.
Figure 8:
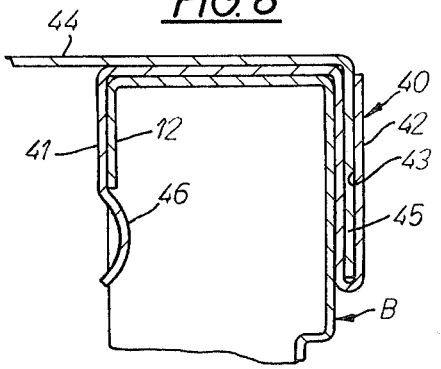
FIG. 8 is a fragmentary sectional view through a gutter and with the cover of FIG. 7 in place.

FIGS. 7 and 8 show a modified form of the invention including lengths or sections 40 which are fabricated or preformed from suitable material, such as metal or plastic. If plastic is used, these sections can be extruded. The sections 40 include a rear flange 41, a front flange 42 and a slot 43 formed along the front edge of the section and facing in an upward direction. The cover 44 includes a downwardly extending flange 45 which is adapted to be slipped into a slot 43 and a snug engagement therewith but yet easily removable by direct upward pull on the cover. The flange 41 of the section 40 includes a lower inwardly turned part 46 (see FIG. 8) which snugly embraces the rear portion 12 of the gutter bead B, thus holding the section 40 snugly and resiliently in place on the rear portion 12 of the bead.

Figure 9:
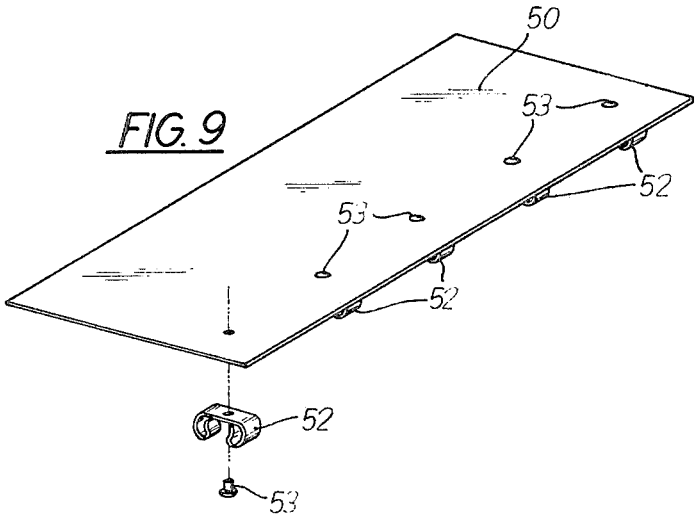
FIG. 9 is another form of gutter cover provided by the present invention.

The modification shown in FIG. 9 includes a generally flat cover 50 having secured along its front edge at spaced intervals, a plurality of broom type clips 52 which are formed of resilient material and which are thus adapted to resiliently engage the bead B of the gutter and thus firmly grasp the bead to hold the cover in place. The clips are secured to the cover 50 by means of rivets 53 in the known manner.

The cover provided by the present invention can be easily and quickly inserted over the gutter and its front edge snaps on or embraces the bead of the gutter to securely hold the cover in place. The cover acts to permit rain, melting snow, or slush to flow from the roof over the gutter where it drips from the outer edge of the gutter downwardly or otherwise prevents its accumulation in the gutter and consequent build-up of ice within. Due to the resiliently gripping action of the gutter attaching means along the front edge of the cover, the cover is prevented from being accidentally displaced or removed, for example by high winds.

The cover provided by the present invention can be easily removed from the gutter when it is no longer needed.

I claim:

1. An elongated cover for extending over and covering a roof gutter, said cover being formed of imperforate sheet material and having a rear edge along its length for being inserted under a row of shingles on a roof, said cover also having a front edge with means therealong for engaging a bead along a front side of said gutter, said means comprising a pair of downwardly extending spaced apart flanges adjacent and along said front edge, which flanges define an inverted generally U-shaped groove, said flanges adapted to embrace said bead, said flanges including an outer flange extending over said front side of said bead and an inner flange formed with a series of slits defining individual tabs, said tabs being individually foldable upwardly to accommodate a gutter hanger secured to said gutter bead.

2. An elongated cover for extending over and covering a roof gutter, said cover being formed of imperforate sheet material and having a rear edge along its length for being inserted under a row of shingles on a roof, said cover also having a front edge with means therealong for engaging a bead along a front side of said gutter, whereby snow and ice are precluded from collecting in said gutter and causing ice to build up under said shingles, said means for engaging a bead including lengths of preformed sections which are adapted to snap over said beads and having an upwardly facing slot formed therein, and said cover includes a downwardly extending flange adapted to slip into said slot for snug engagement therewith.

3. An elongated cover for extending over and covering a roof gutter, said cover having a rear edge along its length for being inserted under a row of shingles on a roof to which said gutter is attached, said cover also having a pair of downwardly extending spaced apart flanges along a front edge thereof which define an inverted generally U-shaped groove, said groove and flanges adapted to embrace a bead along said gutter, said pair of flanges including an outer flange adapted to abut against the outside of said gutter bead and also including an inner flange adapted to abut against the inner side of said gutter bead, said inner flange having a plurality of generally vertical and spaced apart slots which define a series of individual tabs along said inner flange, whereby said tabs may be individually folded upwardly to thereby accommodate a gutter hanger between adjacent tabs, said flanges being formed relative to one another to thereby resiliently grip said gutter bead, whereby snow and ice are precluded from collecting in said gutter and causing ice to build up under said shingles.

4. In combination with a roof gutter of the type having a front edge formed with a reinforcing bead therealong, and elongated cover for extending over and covering said roof gutter, said cover having a rear edge along its length for being inserted under a row of shingles on a roof, said cover also having a front edge and including a pair of downwardly extending spaced apart flanges along said front edge and which define an inverted generally U-shaped groove, said groove adapted to embrace said gutter bead, said flanges including an outer flange adapted to abut against the outside of said gutter bead and also including an inner flange adapted to abut against the inner side of said gutter bead, said inner flange having a plurality of generally vertical and spaced apart slots which define a series of individual tabs along said inner flange, whereby said tabs may be individually folded upwardly to thereby accommodate a gutter hanger located between adjacent tabs, said flanges being formed so as to resiliently grip the said gutter bead to thereby cause said U-shaped groove to resiliently clamp said gutter bead.

* * * * *